US006101637A

United States Patent [19]

Lessard

[11] Patent Number: 6,101,637

[45] Date of Patent: Aug. 15, 2000

[54] SHOULDER PROTECTOR

[76] Inventor: Wilfred E. Lessard, 203 Commonwealth Ave., New Britain, Conn. 06053

[21] Appl. No.: 09/289,814

[22] Filed: Apr. 12, 1999

[51] Int. Cl.[7] ..... A41D 13/00

[52] U.S. Cl. ..... 2/459; 2/45; 2/268

[58] Field of Search ..... 2/459, 44, 45, 2/267, 268, 310, 326–328; 224/259, 264, 265, 201

[56] References Cited

U.S. PATENT DOCUMENTS

| | | | |
|---|---|---|---|
| 378,394 | 2/1888 | Haskins | 2/44 |
| 3,504,377 | 4/1970 | Biggs et al. | 2/44 |
| 4,050,099 | 9/1977 | David et al. . | |
| 4,353,133 | 10/1982 | Williams | 2/45 |
| 4,871,102 | 10/1989 | Wickersham | 224/191 |
| 4,894,868 | 1/1990 | Christopher | 2/268 |
| 5,188,587 | 2/1993 | McGuire et al. | 2/45 |
| 5,319,806 | 6/1994 | Herman et al. . | |

*Primary Examiner*—Gloria M. Hale
*Assistant Examiner*—Tejash Patel
*Attorney, Agent, or Firm*—OURPAL (R) Asija

[57] ABSTRACT

The system of this invention describes shoulder pads for workers who need to carry heavy or cumbersome objects safely, comfortably and with ease. It comprises an interchangeable shoulder pad made from a comfortable and wear resistant material with a pair of front and back adjustable straps that connect to a worker's belt, pants or other clothing on the waist of the worker. The interchangeable nature of this pad permits the same pad to be used on the left or right side. The pad is specially contoured for the neck and shoulder and underlined with suade so as not to slip.

3 Claims, 3 Drawing Sheets

SHOULDER PROTECTOR

BACKGROUND

This invention relates to shoulder pads for workers who need to carry heavy or cumbersome objects safely, comfortably and with ease. More comprehensively it relates to all trades of construction where workers carry equipment, tools, wooden boards, pipes, conduit, bricks, angle iron, ladders and general construction equipment and/or parts over their shoulders.

THE PROBLEM

Many workers have inadvertently injured their back or otherwise injured themselves while carrying and transporting heavy objects on their shoulders. The purpose of the shoulder pad of this invention is to prevent such injury. Because of the weight of the items being carried and the need to be mobile and move this equipment, tools and/or parts to various parts of a construction site, a well recognized unmet and unsolved need for such a product has existed for a long time.

SUMMARY

The system of this invention comprises an interchangeable shoulder pad made from a comfortable and wear resistant material with a pair of front and back adjustable straps that connect to a workers belt, pants or other clothing on the waist of the worker. The interchangeable nature of this pad permits the same pad to be used on the left or right side. The pad is specially contoured for the neck so as not to slip.

PRIOR ART

A formal prior art search was not commissioned but the inventor has done an informal search and he is also intimately familiar with the prior art. Typical examples of the prior art known to the inventor or his attorney are as follows which are arranged the reverse chronological order for the ready reference of the reader.

a) U.S. Pat. No. 5,319,806 bestowed upon Hermann et al on Jun. 14, 1994 for "Shoulder Guard Harness"

b) U.S. Pat. No. 4,050,099 honorably issued to Nel David on Sep. 27, 1977 for "Shoulder Protector"

Unfortunately none of the prior art devices singly or even in combination provide all of the features and objectives established by the inventor for this system as enumerated below.

OBJECTIVES

1. It is an objective of this invention to provide method, devices and system for comfortably carrying heavy objects on a worker's shoulder.

2. Another objective of this invention is to provide a shoulder saver shoulder pad which is interchangeably useable on either left or right shoulder with equal facility.

3. Another objective of this invention is that it be long lasting made from durable material.

4. Another objective of this invention is that it is easy to use, store and transport.

5. Another objective of this invention is that its use be intuitive that requires little additional training.

6. Another objective of this invention is that it be physically safe in normal environment as well as accidental situations.

7. Another objective of this invention is that it be environmentally friendly and safe and made from bio-degradable materials to the extent practical.

8. Another objective of this invention is that it meet all OSHA and all other applicable federal, state, local and other private standards, guidelines and recommendations with respect to safety, environment, quality and energy consumption.

9. Another objective of this invention is that it be comfortable to wear.

10. Another objective of this invention is that it increase the productivity of the worker.

11. Another objective of this invention is that it enhance the safety of the worker by reducing neck, shoulder and back injuries.

12. Another objective of this invention is that it lower the life cycle cost of the projects by reducing the workers' compensation claims.

13. Another objective of this invention is that it be suitable for use anywhere by any worker of any gender size weight, shape etc.

14. Another objective of this invention is that it be suitable for promotional give aways to workers complete with message of the sponsor.

15. Another objective of this invention is that it be suitable for carrying all types, shapes and sizes of objects of reasonable weight.

16. Another objective of this invention is that it be made form durable light weight comfortable material such as leather and or suade.

17. Another objective of this invention is that it be easy to put on, change shoulder, remove, store, transport etc.

18. Another objective of this invention is that it not slip from or pinch the shoulder of the wearer.

Other objectives of this invention reside in its simplicity, elegance of design, ease of manufacture, service and use and even aesthetics as will become apparent from the following brief description of the drawings and concomitant description.

BRIEF DESCRIPTION OF THE DRAWINGS a) FIG. 1 is a 3D perspective view of the shoulder saver shoulder pad of this invention being worn by a worker carrying a pipe.

b) FIG. 2 is a 3D perspective isometric view of the shoulder pad of this invention being worn by another worker but without any load.

c) FIG. 3 is a 3D perspective isometric view of the shoulder pad of this invention complete with front and back straps and connecting interface.

DETAILED DESCRIPTION OF THE PREFERRED EMBODIMENT

Figure 1:
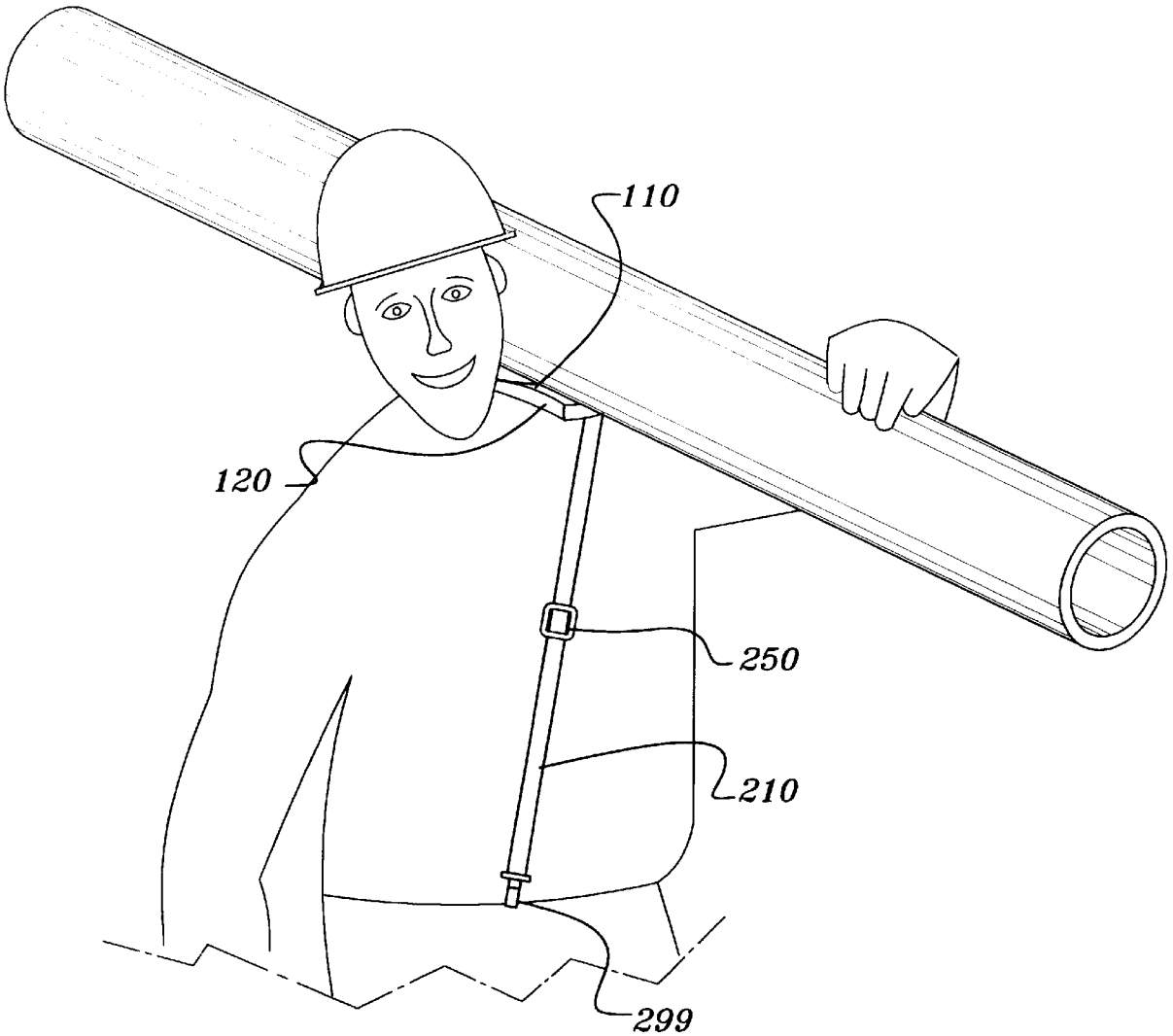

The shoulder saver shoulder pad system of this invention as shown in the drawings wherein like numerals represent like parts throughout the several views, there is generally disclosed in FIG. 1 is a 3D perspective view of the shoulder saver shoulder pad 100 of this invention being worn by a worker on a shoulder 99 via strap 210 incorporating therein an length adjustable means 250.

The shoulder pad 100 can be worn on left or right shoulder 99 and in either case the neck interface 110 faces the neck and the end interface 120 is on the outside above the shoulder.

Figure 2:
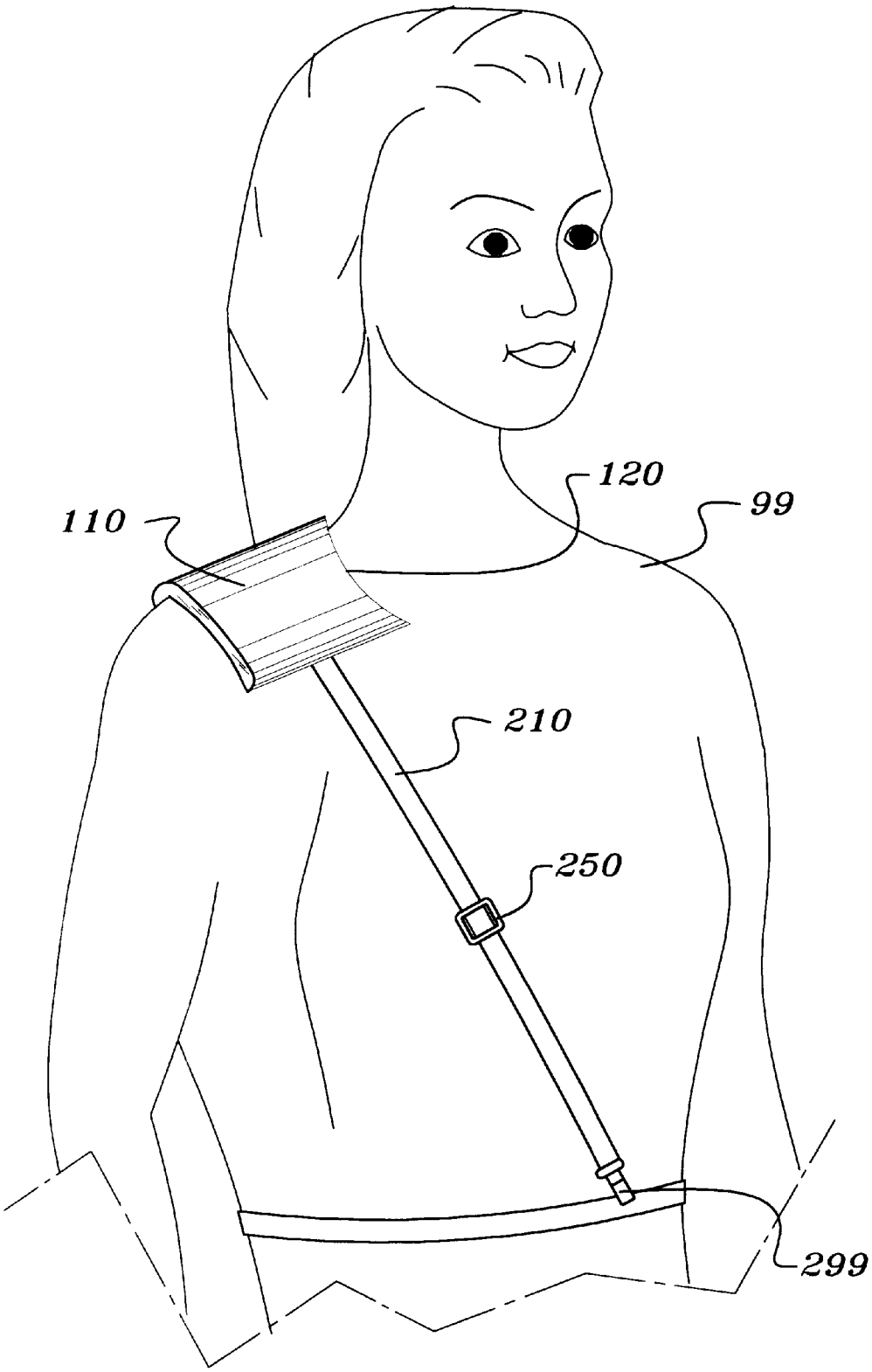

FIG. 2 is a 3D perspective isometric view of the shoulder pad 99 of this invention being worn by another worker but without any load.

Figure 3:
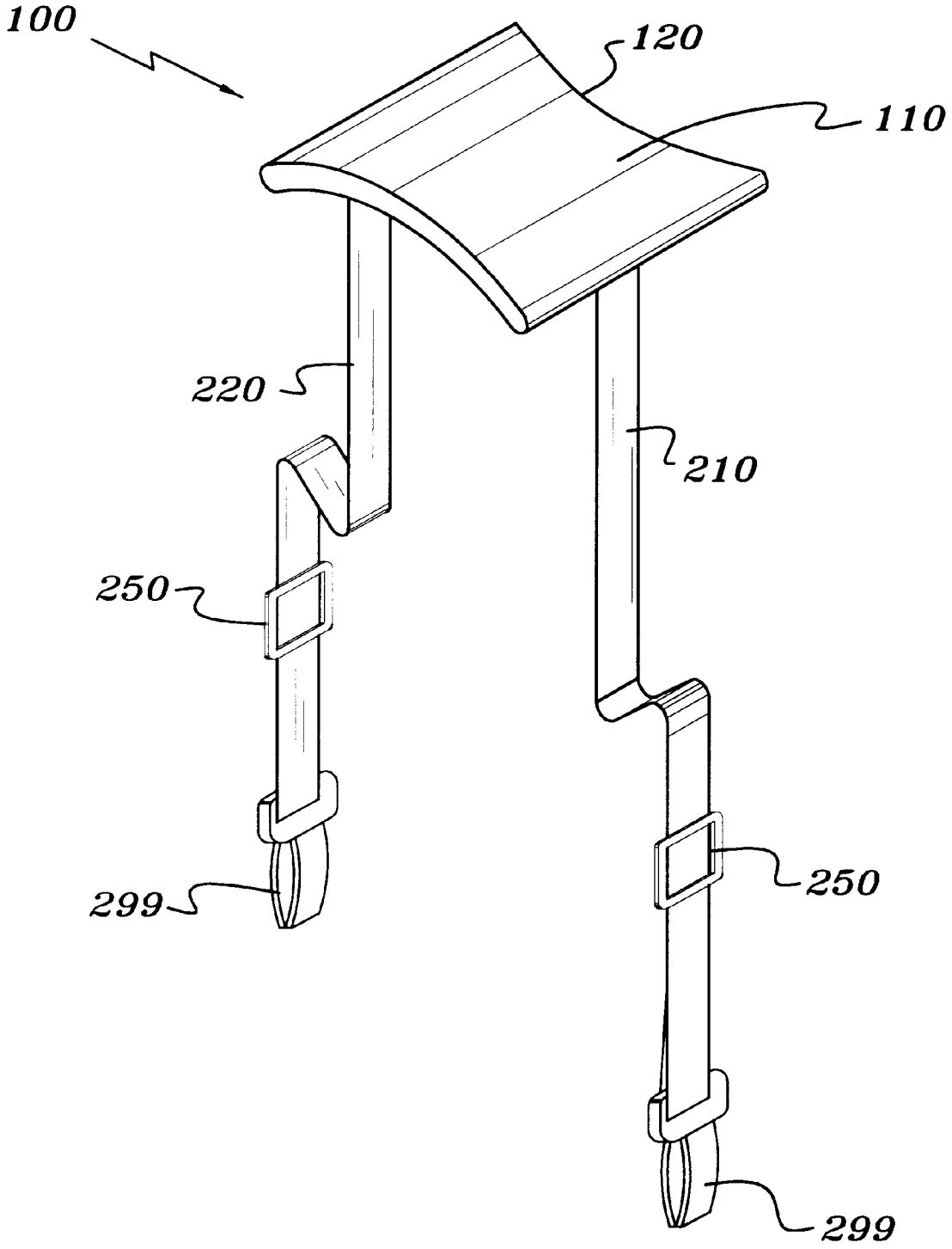

FIG. 3 is a 3D perspective view of the shoulder pad 100 of this invention complete with front strap 210 and back strap 220 and waist connecting interface 299. The shoulder pad has neck interface 110, end interface 120, convex top interface 130 and concave bottom interface 140.

This product is designed as a saddle-type implement which is fitted over the shoulder 99 with a rounded out section 110 as neck interface on one side to accommodate the neck for comfort. The product is attached to the workers belt or pants with suspender type clips 299. The straps 200 go diagonally across the chest and back securing the shoulder saver shoulder pad of this invention in a comfortable position over the shoulder 99 and allowing it to stay in place.

The top convex portion 130 of the shoulder saver is made of leather for durability. The concave underside 140 the side touching the shoulder is made of suade, for added durability and to eliminate slipping off the shoulder.

The inside of the shoulder pad the saddle part is filled with neoprene type foam material as a padding to insure workers' comfort by allowing them to carry THEIR tools, equipment and/or material without having the shoulder pinched or injured with the full weight of the item being carried.

OPERATION

The use and operation of this device by a consumer is simple and even intuitive, nonetheless the inventor recommends the following steps.

1. Position the shoulder pad on left or right shoulder with convex side up and contour facing the neck.

2. Position front and back suspenders diagonally in front and back.

3. Connect interface connectors to the waist belt or pants on opposite side.

4. Adjust the straps by the length adjustable means provided in each strap.

The inventor has given a non-limiting description of the concept. The simplicity and the elegance of the design of this invention makes it difficult to design around it. Nonetheless many changes may be made to this design without deviating from the spirit of this invention. Examples of such contemplated variations include the following:

1. The shape and size materials, aesthetics of the various members and components may be modified.

2. Additional complimentary and complementary functions and features may be added.

3. A more economical version of the device may be adapted

4. A different type of cushion may be provided.

Other changes such as aesthetics and substitution of newer materials as they become available, which substantially perform the same function in substantially the same manner with substantially the same result without deviating from the spirit of the invention may be made.

Following is a listing of the components uses in this embodiment arranged in ascending order of the reference numerals for ready reference of the reader.

99=Shoulder of a worker

100=Shoulder pad or cushion generally

120=Neck Contour Interface

130=Convex top surface

140=Concave bottom surface

200=Strap

210=Front Strap

220=Rear Strap

250=Means for adjusting strap length

299=Waist Interface

DEFINITIONS AND ACRONYMS

A great care has been taken to use words with their conventional dictionary definitions. Following definitions are included here for clarification.

3D=Three Dimensional

Integrated=Combination of two entities to act like one

Interface=Junction between two dissimilar entities

Isometric=Drawings with equality of measure with the prototype of the inventor

OSHA=Occupational Safety & Health Act

OEM=Original Equipment Manufacturer

Symmetrical=The shape of an object of integrated entity which can be divided into two along some axis through the object or the integrated entity such that the two halves form mirror image of each other.

While this invention has been described with reference to illustrative embodiments, this description is not intended to be construed in a limiting sense. Various modifications and combinations of the illustrative embodiments as well as other embodiments of the invention will be apparent to a person of average skill in the art upon reference to this description. It is therefor contemplated that the appended claim(s) cover any such modifications, embodiments as fall within the true scope of this invention.

The inventor claims:

1. A shoulder saver shoulder cushion pad comprising:

a cushion and a means for holding said cushion on a shoulder of a worker;

said cushion is filled with a soft material;

includes a leather convex top;

includes a concave suede bottom;

includes distal opposed side edges having concave neck interfaces, which conforms to a wearer's neck; and thereby making said shoulder pad suitable for wearing on either shoulder of a worker; and said cushion is connected via an interface to the waist of the worker.

2. The shoulder pad of claim 1 wherein said interface is to a belt.

3. The shoulder pad of claim 1 wherein said interface is to the pants of the worker.

* * * * *